US007935664B2

(12) United States Patent
Dowding et al.

(10) Patent No.: US 7,935,664 B2
(45) Date of Patent: May 3, 2011

(54) LUBRICATING OIL COMPOSITION

(75) Inventors: Peter J. Dowding, Wantage (GB); Christopher J. Adams, Reading (GB)

(73) Assignee: Infineum International Limited (GB)

( * ) Notice: Subject to any disclaimer, the term of this patent is extended or adjusted under 35 U.S.C. 154(b) by 346 days.

(21) Appl. No.: 12/243,150

(22) Filed: Oct. 1, 2008

(65) Prior Publication Data

US 2009/0093385 A1 Apr. 9, 2009

(30) Foreign Application Priority Data

Oct. 4, 2007 (EP) ..... 07117914

(51) Int. Cl.

| | |
|---|---|
| ***C10M 159/22*** | (2006.01) |
| ***C10M 159/12*** | (2006.01) |
| ***C10L 1/22*** | (2006.01) |
| ***C08F 8/32*** | (2006.01) |

(52) U.S. Cl. ..... 508/460; 508/543; 508/542

(58) Field of Classification Search ..... 508/460, 508/542, 543

See application file for complete search history.

(56) References Cited

U.S. PATENT DOCUMENTS

| | | | | |
|---|---|---|---|---|
| 4,615,813 | A | 10/1986 | Bretz | |
| 2007/0027043 | A1 * | 2/2007 | Le Coent | 508/460 |

FOREIGN PATENT DOCUMENTS

| | | | |
|---|---|---|---|
| EP | 0296674 | B1 | 4/1992 |
| EP | 0778336 | A1 | 6/1997 |
| EP | 1018539 | A2 | 7/2000 |
| WO | WO 97/46645 | A1 | 12/1997 |

* cited by examiner

*Primary Examiner* — Walter D Griffin
*Assistant Examiner* — Frank C Campanell

(57) ABSTRACT

A lubricating oil composition comprising oil of lubricating viscosity and an overbased metal hydrocarbyl-substituted hydroxybenzoate detergent manufactured in the presence of an amine- or ester-based friction modifier.

29 Claims, No Drawings

LUBRICATING OIL COMPOSITION

This invention relates to a lubricating oil composition.

Currently there is a drive in terms of fuel economy for gasoline and diesel engines, which has resulted in increased levels of organic friction modifiers being used in lubricating oil compositions; unfortunately, there are compatibility issues between the friction modifiers and overbased metal hydrocarbyl-substituted hydroxybenzoate detergents, such as salicylate detergents, which are currently resolved by the use of a two-part package, with the friction modifier being added as a top-treat. The present invention is therefore concerned with overcoming the compatibility issues between friction modifiers and overbased metal hydrocarbyl-substituted hydroxybenzoate detergents in lubricating oil compositions.

In accordance with the present invention, there is provided a lubricating oil composition comprising oil of lubricating viscosity and an overbased metal hydrocarbyl-substituted hydroxybenzoate detergent which comprises a friction modifier having: at least one amine group including at least one oxygen atom; or at least one ester group. The 'friction modifier having: at least one amine group including at least one oxygen atom; or at least one ester group' is hereinafter known as 'amine- or ester-based friction modifier'. The overbased metal hydrocarbyl-substituted hydroxybenzoate detergent is manufactured in the presence of the amine- or ester-based friction modifier so that the friction modifier is incorporated into the detergent.

Friction modifiers are generally long, slender molecules added to lubricants for the purpose of minimizing light surface contacts. They have a polar end (head) and an oil-soluble end (tail). The tail is normally a straight hydrocarbon chain including at least 10 carbon atoms, preferably 10-40 carbon atoms, more preferably 12-25 carbon atoms, and even more preferably 15-22 carbon atoms. If the tail is too long or too short, the molecule will not function as a friction modifier. In use, the heads attach to a metal surface and the tails stack side by side.

In the present invention, the overbased metal hydrocarbyl-substituted hydroxybenzoate detergent is synthesized in the presence of either the amine- or ester-based friction modifier in order to produce a hybrid system. The amine- or ester-based friction modifier is preferably added to the reaction components at the start of the manufacture of the overbased metal hydrocarbyl-substituted hydroxybenzoate detergent, as part of the initial charge. Test results show that the overbased metal hydrocarbyl-substituted hydroxybenzoate detergents in accordance with the invention function as both detergents and friction modifiers, and they are surprisingly more stable than corresponding mixtures of overbased metal hydrocarbyl-substituted hydroxybenzoate detergents and amine- or ester-based friction modifiers. Therefore, they may be used in lubricating oil compositions as both the detergent and the friction modifier, which means that separate, additional friction modifiers may not be required.

The amine-based friction modifier is preferably selected from: alkoxylated hydrocarbyl-substituted mono-amines and diamines, and hydrocarbyl ether amines; preferably from alkoxylated tallow amines and alkoxylated tallow ether amines, with alkoxylated amines containing about two moles of alkylene oxide per mole of nitrogen being the most preferred. Ethoxylated amines and ethoxylated ether amines are especially preferred. Such friction modifiers can contain hydrocarbyl groups that can be selected from straight chain, branched chain or aromatic hydrocarbyl groups or admixtures thereof, and may be saturated or unsaturated or a mixture thereof. More preferred are those with linear hydrocarbyl groups. Hydrocarbyl groups are predominantly composed of carbon and hydrogen but may contain one or more hetero atoms such as sulphur or oxygen. Preferred hydrocarbyl groups range from 12 to 25 carbon atoms, preferably 15 to 22 carbon atoms. Preferred structures are illustrated by (but not limited to) the two figures below:

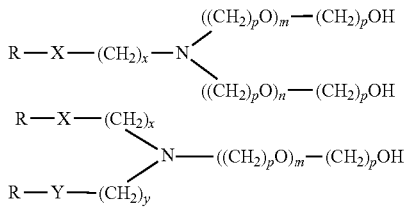

wherein R is a $C_6$ to $C_{28}$ alkyl group, preferably a $C_{15}$ to $C_{22}$ alkyl group, X and Y are independently O or S or $CH_2$, x and y are independently 1 to 6, p is 2 to 4 (preferably 2), and m and n are independently 0 to 5. The alkyl group or groups are sufficiently linear in character to impart friction modifier properties.

The ester-based friction modifier is preferably selected from partially esterified aliphatic polyhydric alcohols having from two to 30 carbon atoms and containing from two to six hydroxyl groups, wherein at least one free hydroxyl group remains. Preferably, at least one hydroxyl group should be on a terminal carbon atom, but it may be removed from the terminal carbon atom by as many as three or four carbon atoms. The partial ester alcohols may be derivatives of, for example, alkylene glycols (especially ethylene and propylene glycol), glycerol, erythritol, pentaerythritol, and the various isomeric pentitols and hexitols, such as mannitol, sorbitol, etc.

To the polyhydric alcoholic portion of the molecule there is preferably attached a predominantly hydrocarbon portion containing a number of carbon atoms sufficient to give the molecule a total minimum carbon content of about 12, and preferably 12 to 40 carbon atoms, more preferably 15 to 22 carbon atoms. This hydrocarbon portion is generally attached to the alcoholic portion through an ester linkage which may be formed between a hydroxyl radical of the polyhydric alcohol on the one hand, and an acid radical of the hydrocarbon portion on the other. It is also possible for the ester linkage to be inverted, that is to say for it to be formed between an acid radical attached to the polyhydric alcohol on the one hand and a hydroxyl radical attached to the hydrocarbon on the other.

It is desirable that the hydroxyl radicals and ester linkages of the polyhydric alcohol portion of the ester should be as close together as possible, preferably at least two hydroxyl radicals being separated from each other by not more than three directly connected atoms, and more preferably being attached to vicinal carbon atoms. It is advantageous if several polar groups are attached to directly connected carbon atoms.

The hydrocarbon portion of the ester should preferably have at least five and more preferably between about 10 and 40 carbon atoms, more preferably 15 to 22 carbon atoms, and be in the form of a branched- or straight-chain aliphatic or a cycloaliphatic (e.g. naphthenic) radical, with a straight-chain aliphatic radical being preferred. The acid group of the hydrocarbon portion (if there is one) is preferably a carboxylic acid group. The acid may be, for example, caprylic, oleic, stearic, lauric, linoleic, linolenic or ricinoleic acid etc.

Specially preferred partial esters are sorbitan mono-oleate and sorbitan mono-laurate, and in particular glycerol mono- and di-oleate, and mixtures thereof.

In accordance with the present invention, there is also provided use in a lubricating oil composition as a detergent and a friction modifier of an overbased metal hydrocarbyl-substituted hydroxybenzoate detergent which comprises a friction modifier having: at least one amine group including at least one oxygen atom; or at least one ester group.

The overbased metal hydrocarbyl-substituted hydroxybenzoate detergent is preferably prepared by adding at least one amine- or ester-based friction modifier to the initial charge of the reaction mixture.

In accordance with the present invention, there is also provided a method for preparing an overbased metal hydrocarbyl-substituted hydroxybenzoate detergent which comprises a friction modifier having: at least one amine group including at least one oxygen atom; or at least one ester group; the method comprising the following steps:

providing a mixture of a hydrocarbyl-substituted hydroxybenzoic acid, a hydrocarbon solvent, an alcohol, at least one friction modifier having at least one amine group including at least one oxygen atom or at least one ester group, and a stoichiometric excess of an alkali metal or alkaline earth metal base (e.g. metal hydroxide, metal oxide, metal alkoxide and the like) above that required to react with the hydroxybenzoic acid; and overbasing the mixture with an overbasing agent.

In accordance with the present invention, there is also provided a method of reducing friction in an engine; the method comprising the step of lubricating the engine with a lubricating oil composition comprising oil of lubricating viscosity and an overbased metal hydrocarbyl-substituted hydroxybenzoate detergent which comprises a friction modifier having: at least one amine group including at least one oxygen atom; or at least one ester group.

The engine is preferably an automotive engine, especially a gasoline engine.

The overbased metal hydrocarbyl-substituted hydroxybenzoate detergent is preferably an overbased metal alkylsalicylate detergent, and more preferably an overbased calcium alkylsalicylate detergent.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps"; that is metal salts of acidic organic compounds, sometimes referred to as surfactants.

Detergents generally comprise a polar head with a long hydrophobic tail, the polar head comprising a metal salt of an acidic organic compound. Large amounts of a metal base can be included by reacting an excess of a metal base, such as an oxide or hydroxide, with an acidic gas such as carbon dioxide to give an overbased detergent which comprises neutralised detergent as the outer layer of a metal base (e.g. carbonate) micelle.

The surfactant of the present invention is a hydrocarbyl-substituted hydroxybenzoic acid. Hydrocarbyl includes alkyl or alkenyl. The overbased metal hydrocarbyl-substituted hydroxybenzoate typically has the structure shown:

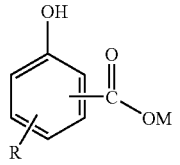

wherein R is a linear or branched aliphatic group, preferably a hydrocarbyl group, and more preferably an alkyl group, including branched- or, more preferably, straight-chain alkyl groups. There may be more than one R group attached to the benzene ring. M is an alkali (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art.

In hydrocarbyl-substituted hydroxybenzoic acids, the hydrocarbyl group is preferably alkyl (including branched- or, more preferably, straight-chain alkyl groups), and the alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term 'low-based' is used to describe metal detergents in which the equivalent ratio of metal moiety to acid moiety is greater than 1, and up to about 2. The term 'over-based' is used to describe metal detergents in which the equivalent ratio of metal moiety to acid moiety is greater than 1.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents is preferably expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). Preferred detergents according to the invention have a TBN of greater than 150.

Overbased metal hydrocarbyl-substituted hydroxybenzoates can be prepared by any of the techniques employed in the art. A general method is as follows:

1. Neutralisation of hydrocarbyl-substituted hydroxybenzoic acid with molar excess of metallic base to produce a slightly overbased metal hydrocarbyl-substituted hydroxybenzoate complex, in a solvent mixture consisting of a volatile hydrocarbon, an alcohol and water;
2. Carbonation to produce colloidally dispersed metal carbonate followed by post-reaction period;
3. Removal of residual solids that are not colloidally dispersed; and
4. Stripping to remove process solvents.

In this invention, the charge of friction modifier can be added at any point of the above process, but is preferably added in the initial charge.

Overbased metal hydrocarbyl-substituted hydroxybenzoates can be made by either a batch or a continuous overbasing process.

Metal base (e.g. metal hydroxide, metal oxide, metal alkoxide and the like), preferably lime (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the solvent mixture.

Carbonation may by effected in one or more stages, over a range of temperatures up to the reflux temperature of the alcohol promoters. Addition temperatures may be similar, or different, or may vary during each addition stage. Phases in which temperatures are raised, and optionally then reduced may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. The ratio of alkanol to hydrocarbon solvents is important. If there is too much alkanol the resulting product will be greasy, whereas with too much hydrocarbon solvent there will be excessive viscosity of the reaction mixture whilst carbon dioxide and any calcium hydroxide are added.

The water content of the initial reaction mixture is important to obtain the desired product.

Oil may be added to the reaction mixture; if so, suitable oils include hydrocarbon oils, particularly those of mineral origin. Oils which have viscosities of 15 to 30 cSt at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are generally used as an oil solution. If there is insufficient oil present in the reaction mixture to retain an oil solution after removal of the volatiles, further oil should be added. This may occur before, or at an intermediate point, or after solvent removal.

Additional materials may form an integral part of the overbased metal detergent. These may, for example, include long chain aliphatic mono- or di-carboxylic acids. Suitable carboxylic acids included stearic and oleic acids, and polyisobutylene (PIB) succinic acids.

The detergent may also contain a further surfactant group, such as groups selected from: phenol, sulphonic acid, carboxylic acid and naphthenic acid, that may be obtained by manufacture of a hybrid material in which two or more different surfactant groups are incorporated during the overbasing process.

Examples of hybrid materials are an overbased calcium salt of surfactants salicylic acid and phenol; an overbased calcium salt of surfactants salicylic acid and sulphonic acid; an overbased calcium salt of surfactants salicylic acid and carboxylic acid; and an overbased calcium salt of surfactants salicylic acid, phenol and sulphonic acid.

Preferably, the TBN of the hybrid detergent is at least 300, such as at least 350, more preferably at least 400, most preferably in the range of from 400 to 600, such as up to 500.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

Particular examples of hybrid materials include, for example, those described in WO-A-97/46643; WO-A-97/46644; WO-A-97/46645; WO-A-97/46646; and WO-A-97/46647.

The detergent may also be, for example, a sulphurized and overbased mixture of a calcium alkyl salicylate and a calcium alkyl phenate: an example is described in EP-A-750,659, namely:

a detergent-dispersant additive for lubricating oil of the sulphurised and superalkalinised, alkaline earth alkylsalicylate-alkylphenate type, characterised in that:

a) the alkyl substituents of the said alkylsalicylate-alkylphenate are in a proportion of at least 35 wt. % and at most 85 wt. % of linear alkyl in which the number of carbon atoms is between 12 and 40, preferably between 18 and 30 carbon atoms, with a maximum of 65 wt. % of branched alkyl in which the number of carbon atoms is between 9 and 24 and preferably 12 carbon atoms;
b) the proportion of alkylsalicylate in the alkylsalicylate-alkylphenate mixture is at least 22 mole % and preferably at least 25 mole %, and
c) the molar proportion of alkaline earth base with respect to alkylsalicylate-alkylphenate as a whole is between 1.0 and 3.5.

The amine- or ester-based friction modifier is preferably selected from: glyceryl monoesters of higher fatty acids, for example, glyceryl mono-oleate; esters of long chain polycarboxylic acids with diols, for example, the butane diol ester of a dimerized unsaturated fatty acid; and alkoxylated alkyl-substituted mono-amines, diamines and alkyl ether amines, for example, ethoxylated tallow amine and ethoxylated tallow ether amine.

The lubricating oil composition may also include at least one friction modifier. The friction modifier may be selected from the friction modifiers mentioned above. Other known friction modifiers may also be present in the lubricating oil composition, such as, for example, oil-soluble organo-molybdenum compounds. Such organo-molybdenum friction modifiers also provide antioxidant and antiwear credits to a lubricating oil composition. As an example of such oil-soluble organo-molybdenum compounds, there may be mentioned the dithiocarbamates, dithiophosphates, dithiophosphinates, xanthates, thioxanthates, sulphides, and the like, and mixtures thereof. Particularly preferred are molybdenum dithiocarbamates, dialkyldithiophosphates, alkyl xanthates and alkyithioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

The molybdenum compounds may be of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1 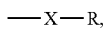

2 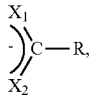

3 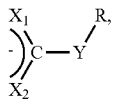

4 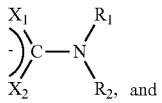

5 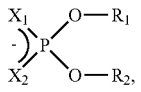

and mixtures thereof, wherein X, $X_1$, $X_2$, and Y are independently selected from the group of oxygen and sulphur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulphoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkyixanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds requires selection of ligands having the appropriate charge to balance the core's charge.

Compounds having the formula $Mo_3S_kL_nQ_z$ have cationic cores surrounded by anionic ligands and are represented by structures such as

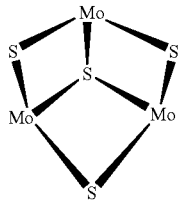

and

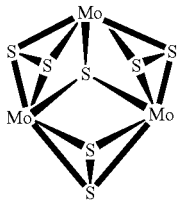

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulphur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkyithiuram disulphide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulphide, dialkyldithiocarbamate, or dialkyldithiophosphate, and a sulphur abstracting agent such cyanide ions, sulphite ions, or substituted phosphines. Alternatively, a trinuclear molybdenum-sulphur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. At least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulphide and mixtures thereof. Most preferably, the molybdenum compound is present as molybdenum dithiocarbamate. The molybdenum compound may also be a trinuclear molybdenum compound.

The lubricating oil composition may include at least one antiwear agent or antioxidant agent. Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

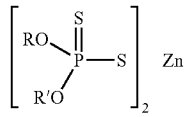

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 wt. %, preferably from about 0.03 to about 0.10 wt. %. More preferably, the phosphorous level of the lubricating oil composition will be less than about 0.08 wt. %, such as from about 0.05 to about 0.08 wt. %.

The lubricating oil composition may include at least one oxidation inhibitor. Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkyiphenolthioesters having preferably $C_5$ to $C_{12}$ alkyl side chains, alkylphenol sulphides, oil soluble phenates and sulphurized phenates, phosphosulphurized or sulphurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 wt. % active ingredient.

The lubricating oil composition may include at least one viscosity modifier. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprenetbutadiene, as well as the partially hydrogenated homopolymers of butadiene and isoprene.

The lubricating oil composition may include at least one viscosity index improver. A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, so the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

The lubricating oil composition may include at least one pour point depressant. Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the lubricating oil composition, it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating oil compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0.01-1.5 |
| Viscosity Modifier | 0.01-10 | 0.25-3 |
| Basestock | Balance | Balance |

Preferably, the Noack volatility of the fully formulated lubricating oil composition (oil of lubricating viscosity plus all additives) will be no greater than 12, such as no greater than 10, preferably no greater than 8.

It may be desirable, although not essential, to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 18 mass %, typically 10 to 15 mass % of the concentrate, the remainder being oil of lubricating viscosity.

The lubricating oils may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base stock, or a mixture thereof provided that the volatility of the oil or oil blend, as measured by the Noack test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from about 130 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention will now be described by reference to the following examples; however, the present invention is not limited to the following examples:

EXAMPLES

Methods for the synthesis of alkylsalicylic acid, and the formation of overbased detergents derived therefrom, are well known to those skilled in the art. For example, such methods are described in US 2007/0027043 and references cited therein. The alkylsalicylic acid used in these Examples was made from C14-C18 linear alpha-olefins, such as those marketed by Shell Chemicals under the name SHOP. It contained approximately 10% moles of unconverted alkyiphenol, and had an acid content of 2.62 meq./g.

The overbased metal salicylate detergents were prepared using the following method:

TABLE 1

| | Charges (g) | |
|---|---|---|
| Example | Overbased Salicylate Detergent | Overbased Salicylate Detergent Manufactured in Presence of Friction Modifier |
| Alkylsalicylic acid | 300 | 300 |
| Xylene | 386.4 | 386.4 |
| Calcium hydroxide | 72.47 | 72.47 |
| Methanol | 73.98 | 73.98 |
| Distilled water | 2.29 | 2.29 |
| Carbon dioxide | 18.57 | 18.57 |
| Base oil SN150 | 150 | 150 |
| Friction Modifier | 0 | 45 |

Method

Xylene and alkylsalicylic acid (and friction modifier if in accordance with the invention) were mixed together in a flask stirred at 600 rpm, and heated to 40° C. in 20 minutes.

Lime was added to the flask, and the mixture was stirred at 600 rpm and 55° C. for 60 minutes.

Methanol and water were added to the flask, and the mixture was stirred at 600 rpm and 55° C. for 40 minutes.

Carbon dioxide was added at a rate of 0.52 liters/minute at 55° C.

The mixture was stirred at 600 rpm and 55° C. for 20 minutes.

The mixture was left at room temperature for five minutes.

The mixture was centrifuged at 2500 rpm for 30 minutes.

After centrifugation the methanol/water formed a cloudy layer on the surface, which was removed using a vacuum pump.

Base oil was added.

Xylene, and any residual methanol and water, were stripped off using a rotary evaporator at 135° C. for two hours.

The following overbased calcium salicylate detergents were prepared:

TABLE 2

| Examples | Modified Overbased Calcium Salicylate Detergents |
|---|---|
| Example 1 | 168 TBN Calcium Salicylate detergent manufactured in the presence of 7.7% of Glycerol Monooleate Friction Modifier (Atsurf 594, available from Uniqema) |
| Example 2 | 168 TBN Calcium Salicylate detergent manufactured in the presence of 7.7% of ethoxylated tallow amine (ETHOMEEN T/12, available from Akzo Nobel) |
| Comparative Example 3 | 168 TBN Calcium Salicylate detergent manufactured in the presence of 7.7% of Oleamide Friction Modifier (Armid O, available from Akzo Nobel) |

The overbased calcium salicylate detergents in Table 1 and a 168 TBN calcium salicylate were blended into the following blends:

TABLE 3

| | Comp. Blend 1 | Blend 2 | Comp. Blend 3 | Blend 4 | Comp. Blend 5 | Comp. Blend 6 | Comp. Blend 7 |
|---|---|---|---|---|---|---|---|
| 168 TBN Calcium Salicylate, available from Infineum UK Ltd | 40 | | 40 | | 40 | | 40 |
| Example 1 from Table 1 | | 40 | | | | | |
| Example 2 from Table 1 | | | | 40 | | | |
| Comparative Example 3 from Table 1 | | | | | | 40 | |
| Dispersant, available from Infineum UK Ltd | 87.5 | 87.5 | 87.5 | 87.5 | 87.5 | 87.5 | 87.5 |
| ZDDP, available from Infineum UK Ltd | 12.2 | 12.2 | 12.2 | 12.2 | 12.2 | 12.2 | 12.2 |
| Glycerol Monooleate Friction Modifier, Atsurf 594, available from Uniqema | — | — | 4.0 | — | — | — | — |
| Ethoxylated Tallow Amine Friction Modifier, ETHOMEEN T/12, available from Akzo Nobel | — | — | — | — | 4.0 | — | — |
| Oleamide Friction Modifier, Armid O, available from Akzo Nobel | — | — | — | — | — | — | 4.0 |
| Total | 139.7 | 139.7 | 143.7 | 139.7 | 143.7 | 139.7 | 143.7 |

The blends were tested for their stability by storing them at 60° C. for 12 weeks and observing them at weekly intervals. The results refer to the number of weeks after which instability manifested itself as haze and/or sediment. A result was considered as a failure for sediment levels of >0.15%. The results are shown below.

TABLE 4

| | Stability Test Result, weeks |
|---|---|
| Comparative Blend 1 | 3 |
| Blend 2 | 5 |
| Comparative Blend 3 | 0 |
| Blend 4 | 5 |
| Comparative Blend 5 | 0 |
| Comparative Blend 6 | 0 |
| Comparative Blend 7 | 0 |

Table 4 shows that the presence of friction modifiers as components of a blend results in poor stability (compare Comparative Blend 1 which does not include a friction modifier to Comparative Blend 3 which includes a friction modifier). However, if the friction modifier is supplied via a hybrid system as in Blends 2 and 4, which are in accordance with the present invention, the hybrids are surprisingly more stable than corresponding mixtures of overbased metal salicylate detergents and amine- or ester-based friction modifiers.

The invention claimed is:

1. A lubricating oil composition comprising oil of lubricating viscosity and an overbased metal hydrocarbyl-substituted hydroxybenzoate detergent which comprises a friction modifier having: at least one amine group including at least one oxygen atom; or at least one ester group, wherein the friction modifier includes a straight hydrocarbon chain having 10 to 40 carbon atoms.

2. The lubricating oil as claimed in claim 1, wherein the hydrocarbyl-substituted hydroxybenzoate detergent is an alkylsalicylate.

3. The lubricating oil as claimed in claim 1, wherein the metal in the overbased metal hydrocarbyl-substituted hydroxybenzoate detergent is calcium.

4. The lubricating oil as claimed in claim 1, wherein the friction modifier includes a straight hydrocarbon chain having 12 to 25 carbon atoms.

5. The lubricating oil as claimed in claim 4, wherein the friction modifier includes a straight hydrocarbon chain having 15 to 22 carbon atoms.

6. The lubricating oil as claimed in claim 1, wherein the friction modifier is selected from: alkoxylated hydrocarbyl-substituted mono-amines and diamines, and hydrocarbyl ether amines.

7. The lubricating oil as claimed in claim 1, wherein the friction modifier is selected from alkoxylated amines containing about two moles of alkylene oxide per mole of nitrogen.

8. The lubricating oil as claimed in claim 7, wherein the friction modifier is selected from ethoxylated amines and ethoxylated ether amines.

9. The lubricating oil as claimed in claim 1, wherein the friction modifier is selected from: partially esterified aliphatic polyhydric alcohols having from two to 30 carbon atoms and containing from two to six hydroxyl groups, wherein at least one free hydroxyl group remains.

10. The lubricating oil as claimed in claim 9, wherein the friction modifier is selected from: partial esters of sorbitan mono-oleate and sorbitan mono-laurate, glycerol mono- and di-oleate, and mixtures thereof.

11. A method of preparing the overbased metal hydrocarbyl-substituted hydroxybenzoate detergent as defined in claim 1, the method comprising the following steps:

providing a mixture of a hydrocarbyl-substituted hydroxybenzoic acid, a hydrocarbon solvent, an alcohol, at least one friction modifier having at least one amine group including at least one oxygen atom or at least one ester group, which friction modifier includes a straight hydrocarbon chain having 10 to 40 carbon atoms, and a stoichiometric excess of an alkali metal or alkaline earth metal base above that required to react with the hydroxybenzoic acid; and overbasing the mixture with an overbasing agent.

12. A method of reducing friction in an engine, the method comprising the step of lubricating the engine with the lubricating oil composition as claimed in claim 1.

13. A lubricating oil composition comprising oil of lubricating viscosity and an overbased metal hydrocarbyl-substituted hydroxybenzoate detergent obtained by:

providing a mixture of a hydrocarbyl-substituted hydroxybenzoic acid, a hydrocarbon solvent, an alcohol, at least one friction modifier having at least one amine group including at least one oxygen atom or at least one ester group, which friction modifier includes a straight hydrocarbon chain having 10 to 40 carbon atoms, and a stoichiometric excess of an alkali metal or alkaline earth metal base above that required to react with the hydroxybenzoic acid; and overbasing the mixture with an overbasing agent.

14. A lubricating oil composition comprising oil of lubricating viscosity and an overbased metal hydrocarbyl-substituted hydroxybenzoate detergent which comprises a friction modifier selected from: alkoxylated hydrocarbyl-substituted mono-amines and diamines, and hydrocarbyl ether amines.

15. The lubricating oil as claimed in claim 14, wherein the hydrocarbyl-substituted hydroxybenzoate detergent is an alkylsalicylate.

16. The lubricating oil as claimed in claim 14, wherein the metal in the overbased metal hydrocarbyl-substituted hydroxybenzoate detergent is calcium.

17. The lubricating oil as claimed in claim 16, wherein said alkoxylated hydrocarbyl-substituted mono-amines and diamines are alkoxylated tallow amines and said alkoxylated hydrocarbyl ether amines are alkoxylated tallow ether amines.

18. The lubricating oil as claimed in claim 17, wherein the friction modifier is selected from alkoxylated amines containing about two moles of alkylene oxide per mole of nitrogen.

19. The lubricating oil as claimed in claim 18, wherein the friction modifier is selected from ethoxylated amines and ethoxylated ether amines.

20. A method of preparing the overbased metal hydrocarbyl-substituted hydroxybenzoate detergent as defined in claim 14, the method comprising the following steps:

providing a mixture of a hydrocarbyl-substituted hydroxybenzoic acid, a hydrocarbon solvent, an alcohol, at least one friction modifier selected from: alkoxylated hydrocarbyl-substituted mono-amines and diamines, and hydrocarbyl ether amines and a stoichiometric excess of an alkali metal or alkaline earth metal base above that required to react with the hydroxybenzoic acid; and overbasing the mixture with an overbasing agent.

21. A method of reducing friction in an engine, the method comprising the step of lubricating the engine with the lubricating oil composition as claimed in claim 14.

22. A lubricating oil composition comprising oil of lubricating viscosity and an overbased metal hydrocarbyl-substituted hydroxybenzoate detergent obtained by:

providing a mixture of a hydrocarbyl-substituted hydroxybenzoic acid, a hydrocarbon solvent, an alcohol, at least one friction modifier selected from: alkoxylated hydrocarbyl-substituted mono-amines and diamines, and hydrocarbyl ether amines and a stoichiometric excess of an alkali metal or alkaline earth metal base above that required to react with the hydroxybenzoic acid; and overbasing the mixture with an overbasing agent.

23. A lubricating oil composition comprising oil of lubricating viscosity and an overbased metal hydrocarbyl-substituted hydroxybenzoate detergent which comprises a friction modifier selected from: partially esterified aliphatic polyhydric alcohols having from two to 30 carbon atoms and containing from two to six hydroxyl groups, wherein at least one free hydroxyl group remains.

24. The lubricating oil as claimed in claim 23, wherein the hydrocarbyl-substituted hydroxybenzoate detergent is an alkylsalicylate.

25. The lubricating oil as claimed in claim 23, wherein the metal in the overbased metal hydrocarbyl-substituted hydroxybenzoate detergent is calcium.

26. The lubricating oil as claimed in claim 23, wherein the friction modifier is selected from: partial esters of sorbitan mono-oleate and sorbitan mono-laurate, glycerol mono- and di-oleate, and mixtures thereof.

27. A method of preparing the overbased metal hydrocarbyl-substituted hydroxybenzoate detergent as defined in claim 23, the method comprising the following steps:

providing a mixture of a hydrocarbyl-substituted hydroxybenzoic acid, a hydrocarbon solvent, an alcohol, at least one friction modifier selected from: partially esterified aliphatic polyhydric alcohols having from two to 30 carbon atoms and containing from two to six hydroxyl groups, wherein at least one free hydroxyl group remains and a stoichiometric excess of an alkali metal or alkaline earth metal base above that required to react with the hydroxybenzoic acid; and overbasing the mixture with an overbasing agent.

28. A method of reducing friction in an engine, the method comprising the step of lubricating the engine with the lubricating oil composition as claimed in claim 23.

29. A lubricating oil composition comprising oil of lubricating viscosity and an overbased metal hydrocarbyl-substituted hydroxybenzoate detergent obtained by:

providing a mixture of a hydrocarbyl-substituted hydroxybenzoic acid, a hydrocarbon solvent, an alcohol, at least one friction modifier selected from: partially esterified aliphatic polyhydric alcohols having from two to 30 carbon atoms and containing from two to six hydroxyl groups, wherein at least one free hydroxyl group remains and a stoichiometric excess of an alkali metal or alkaline earth metal base above that required to react with the hydroxybenzoic acid; and overbasing the mixture with an overbasing agent.

* * * * *